US007553122B2

(12) United States Patent
Kirtley

(10) Patent No.: US 7,553,122 B2
(45) Date of Patent: Jun. 30, 2009

(54) SELF-ASPIRATED FLOW CONTROL SYSTEM FOR CENTRIFUGAL COMPRESSORS

(75) Inventor: Kevin Richard Kirtley, Simpsonville, SC (US)

(73) Assignee: General Electric Company, Niskayuna, NY (US)

( * ) Notice: Subject to any disclaimer, the term of this patent is extended or adjusted under 35 U.S.C. 154(b) by 533 days.

(21) Appl. No.: 11/315,454

(22) Filed: Dec. 22, 2005

(65) Prior Publication Data

US 2007/0147987 A1 Jun. 28, 2007

(51) Int. Cl.
*F04D 27/02* (2006.01)

(52) U.S. Cl. ..... 415/1; 415/116

(58) Field of Classification Search ..... 415/58.2, 415/58.4, 116, 1, 57.1, 57.2, 57.3, 58.3
See application file for complete search history.

(56) References Cited

U.S. PATENT DOCUMENTS

| | | | | | |
|---|---|---|---|---|---|
| 2,084,463 | A | | 6/1937 | Stalker | 230/137 |
| 2,305,226 | A | | 12/1942 | Stalker | 230/130 |
| 4,375,937 | A | * | 3/1983 | Cooper | 415/58.5 |
| 4,375,938 | A | * | 3/1983 | Dussourd | 415/58.5 |
| 4,375,939 | A | | 3/1983 | Mount et al. | 415/157 |
| 4,642,026 | A | | 2/1987 | Ruff | 415/150 |
| 4,664,345 | A | | 5/1987 | Lurz | 244/209 |
| 5,308,225 | A | * | 5/1994 | Koff et al. | 415/57.3 |
| 5,431,533 | A | * | 7/1995 | Hobbs | 415/58.7 |
| 5,474,417 | A | * | 12/1995 | Privett et al. | 415/58.5 |
| 5,520,507 | A | | 5/1996 | Haugen | 415/119 |
| 5,536,141 | A | | 7/1996 | Haugen | 415/208.3 |
| 5,586,859 | A | * | 12/1996 | Nolcheff | 415/58.5 |
| 5,605,435 | A | | 2/1997 | Haugen | 415/146 |
| 5,607,284 | A | * | 3/1997 | Byrne et al. | 415/58.5 |
| 5,611,664 | A | | 3/1997 | Haugen | 415/146 |
| 5,863,178 | A | * | 1/1999 | Scheinert et al. | 415/58.4 |
| 7,074,006 | B1 | * | 7/2006 | Hathaway et al. | 415/1 |
| 2002/0192073 | A1 | * | 12/2002 | Japikse | 415/169.1 |
| 2004/0081552 | A1 | | 4/2004 | Guemmer | 415/112 |
| 2004/0250617 | A1 | * | 12/2004 | Klassen | 73/261 |
| 2005/0095127 | A1 | | 5/2005 | Sasu et al. | 415/208.4 |
| 2005/0118019 | A1 | | 6/2005 | Roberts et al. | 415/206 |

* cited by examiner

*Primary Examiner*—Edward Look
*Assistant Examiner*—Aaron R Eastman
(74) *Attorney, Agent, or Firm*—Patrick K. Patnode

(57) ABSTRACT

A flow control system for a centrifugal compressor includes a plurality of suction holes provided in a diffuser and configured to facilitate suction of a flow control stream from a boundary layer fluid from the diffuser. A plurality of blowing holes are provided in a first interconnecting duct coupled to a de-swirl vane unit and configured to facilitate blowing of the flow control stream into the first interconnecting duct. The blowing holes may also be provided in a suction side or an end wall side of the de-swirl vane unit or in a second interconnecting duct coupled between the de-swirl vane unit and an impeller or an upstream diffuser of another compression stage. A manifold is coupled between the suction holes and the blowing holes and configured to direct flow of the flow control stream from the suction holes to the blowing holes.

31 Claims, 7 Drawing Sheets

SELF-ASPIRATED FLOW CONTROL SYSTEM FOR CENTRIFUGAL COMPRESSORS

BACKGROUND

The present invention relates generally to centrifugal compressors and, more specifically, in relation to certain embodiments, to a self-aspirated flow control system for a centrifugal compressor and a method for controlling flow in a centrifugal compressor using such a system.

Centrifugal compressors are often employed in various applications, such as chemical manufacturing, textile plants, petroleum refining, or the like. In fact, centrifugal compressors are employed to increase the pressure of a gaseous fluid, such as air for pumping, or for providing fluid to a downstream device such as a combustor or a turbine. One of the drawbacks arising in the use of centrifugal compressors for applications where the compression load varies over a wide range is flow destabilization (i.e., flow separation) through the compressor. Traditionally, compressor inlets, impellers, and diffuser passages are designed to accommodate a range of volumetric flow rates likely to be required. In the compressor, sometimes a minimum volumetric flow rate is encountered below which stable compressor operation may not be possible. Typically, high incidence on the impeller, boundary layer flow separation along the impeller length or boundary layer flow separation in the diffuser, de-swirl vanes, or interconnecting transition ducts initiates the unstable compressor operation referred as "stall". Below the stall point, the pumping capability of the compressor is significantly reduced and large aerodynamic inefficiency results. Large stable operation range is a critical requirement for compressors to control the diffusion process that leads to boundary layer flow separation.

Traditionally, designers have increased the number of stages of compression or increased the length of interconnecting transition ducts of the compressor to reduce pressure gradients along the flow path and, thus, to prevent significant boundary layer growth which precedes boundary layer flow separation. Unfortunately, adding more compression stages or increasing the length of interconnecting transition ducts results in an increase in the overall dimensions of the compressor and an increase in the number of parts, both of which are generally undesirable.

In one example, traditional multi-stage centrifugal compressors and interconnecting transition ducts are usually compact to reduce the compressor dimensions such as length, diameter, and weight. But, if the interconnecting transition ducts are compact, larger pressure gradients are generated resulting in additional pressure losses. As a result, the efficiency of the compressor is reduced. In another example, diffusion of flow through the 180-degree bend portions of the interconnecting transition ducts between the compression stages is limited by increasing radius of the bend portions or by adding more turning vanes or other metal blockage. In turn, pressure losses are reduced in the interconnecting transition ducts. But increasing the radius of 180-degree bend portions of the interconnecting transition ducts or adding turning vanes or other metal blockage to reduce pressure gradients results in an increase in overall dimensions of the compressor, cost, and number of components.

Therefore, there is a need for an improved system and method for controlling flow in a centrifugal compressor.

BRIEF DESCRIPTION

In accordance with one aspect of the present invention, a flow control system for a centrifugal compressor includes a plurality of suction holes provided in a diffuser and configured to facilitate suction of a flow control stream from a boundary layer fluid of the diffuser. A plurality of blowing holes are provided in a first interconnecting duct coupled to a de-swirl vane unit and configured to facilitate blowing of the flow control stream into a boundary layer fluid in the first interconnecting duct. A manifold is coupled between the suction holes and the blowing holes and configured to direct flow of the flow control stream from the suction holes to the blowing holes. A fluidic oscillator is provided juxtaposed to the blowing holes and configured to facilitate pulsed blowing of the flow control stream into the boundary layer fluid in the first interconnecting duct via the blowing holes.

In accordance with another aspect of the present invention, a flow control system includes a plurality of suction holes provided in a diffuser and configured to facilitate suction of a flow control stream from a boundary layer fluid from the diffuser. A plurality of blowing holes are provided in a second interconnecting duct coupled between a de-swirl vane unit and an impeller; wherein the blowing holes are configured to facilitate blowing of the flow control stream into a boundary layer fluid in the second interconnecting duct. A manifold is coupled between the suction holes and the blowing holes and configured to direct flow of the flow control stream from the suction holes to the blowing holes.

In accordance with another aspect of the present invention, a flow control system includes a plurality of suction holes provided in a diffuser and configured to facilitate suction of a flow control stream from a boundary layer fluid from the diffuser. A plurality of blowing holes are provided on a suction side of a de-swirl vane unit and configured to facilitate blowing of the flow control stream into a boundary layer fluid in the de-swirl vane unit. A manifold is coupled between the suction holes and the blowing holes and configured to direct flow of the flow control stream from the suction holes to the blowing holes.

In accordance with another aspect of the present invention, a flow control system includes a plurality of suction holes provided in a downstream diffuser and configured to facilitate suction of a flow control stream from a boundary layer fluid from the downstream diffuser. A plurality of blowing holes are provided in an upstream diffuser and configured to facilitate blowing of the flow control stream into a boundary layer fluid in the upstream diffuser. A manifold is coupled between the suction holes and the blowing holes and configured to direct flow of the flow control stream from the suction holes to the blowing holes.

In accordance with another aspect of the present invention, a method for controlling fluid flow in a centrifugal compressor includes intaking a flow control stream from a boundary layer fluid via a plurality of suction holes provided in a diffuser. Flow of the flow control stream is directed from the suction holes to a plurality of blowing holes provided in a first interconnecting duct coupled to a de-swirl vane unit. This flow control stream is blown into a boundary layer fluid of the first interconnecting duct coupled to a de-swirl vane unit, via the plurality of blowing holes.

In accordance with another aspect of the present invention, a method for controlling fluid flow in a centrifugal compressor includes intaking a flow control stream from a boundary layer fluid via a plurality of suction holes provided in a diffuser. Flow of the flow control stream is directed from the suction holes to a plurality of blowing holes provided in a second interconnecting duct coupled between a de-swirl vane unit and an impeller. This flow control stream is blown into a boundary layer fluid of the second interconnecting duct coupled to a de-swirl vane unit, via the plurality of blowing holes.

In accordance with another aspect of the present invention, a method for controlling fluid flow in a centrifugal compressor includes intaking a flow control stream from a boundary layer fluid via a plurality of suction holes provided in a diffuser. Flow of the flow control stream is directed from the suction holes to a plurality of blowing holes provided in a de-swirl vane unit. This flow control stream is blown into a boundary layer fluid in the de-swirl vane unit.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in detail below, embodiments of the present invention provide a flow control system for a centrifugal compressor configured to stabilize gaseous fluid flow in the compressor. It has been observed in such compressors that, when the actual volumetric flow rate through the centrifugal compressor is below the stall point, the fluid flow through the compressor becomes unstable from the stalling behavior of a diffuser or an impeller. As a result, the pumping capability of the compressor is limited. The flow control system in accordance with the aspects of the present invention, facilitates suction of a boundary layer fluid from the high pressure diffuser and blowing the boundary layer fluid into a de-swirl vane unit and/or upstream low pressure interconnecting ducts and diffusers to stabilize the gaseous fluid flow in the compressor and suppress the stalling mechanisms. As a result, the aerodynamic performance of the diffuser, de-swirl vane unit and impeller is enhanced. Recirculating the flow control fluid from a downstream side of an impeller to an upstream side of an impeller produces a thermodynamic penalty from the heat of recompressing the flow control fluid. The thermodynamic penalty is offset by the aerodynamic gains and improved range provided by the control of diffusion. Flow control efficacy is further enhanced by using the same flow control fluid for both a suction benefit in the diffuser and blowing benefit in the de-swirl vane or interconnecting ducts. In certain exemplary embodiments, techniques in accordance with aspects of the present invention are disclosed in which the boundary layer fluid is directed as a flow control stream from the high pressure diffuser into the de-swirl vane unit and/or upstream low pressure interconnecting duct of the compressor. Suction and blowing are applied to regions in the compressor where the fluid flow velocity is low or where the boundary layer flow separation is incipient. Various embodiments of these techniques are discussed in further detail below with reference to FIGS. 1-9.

Figure 1:
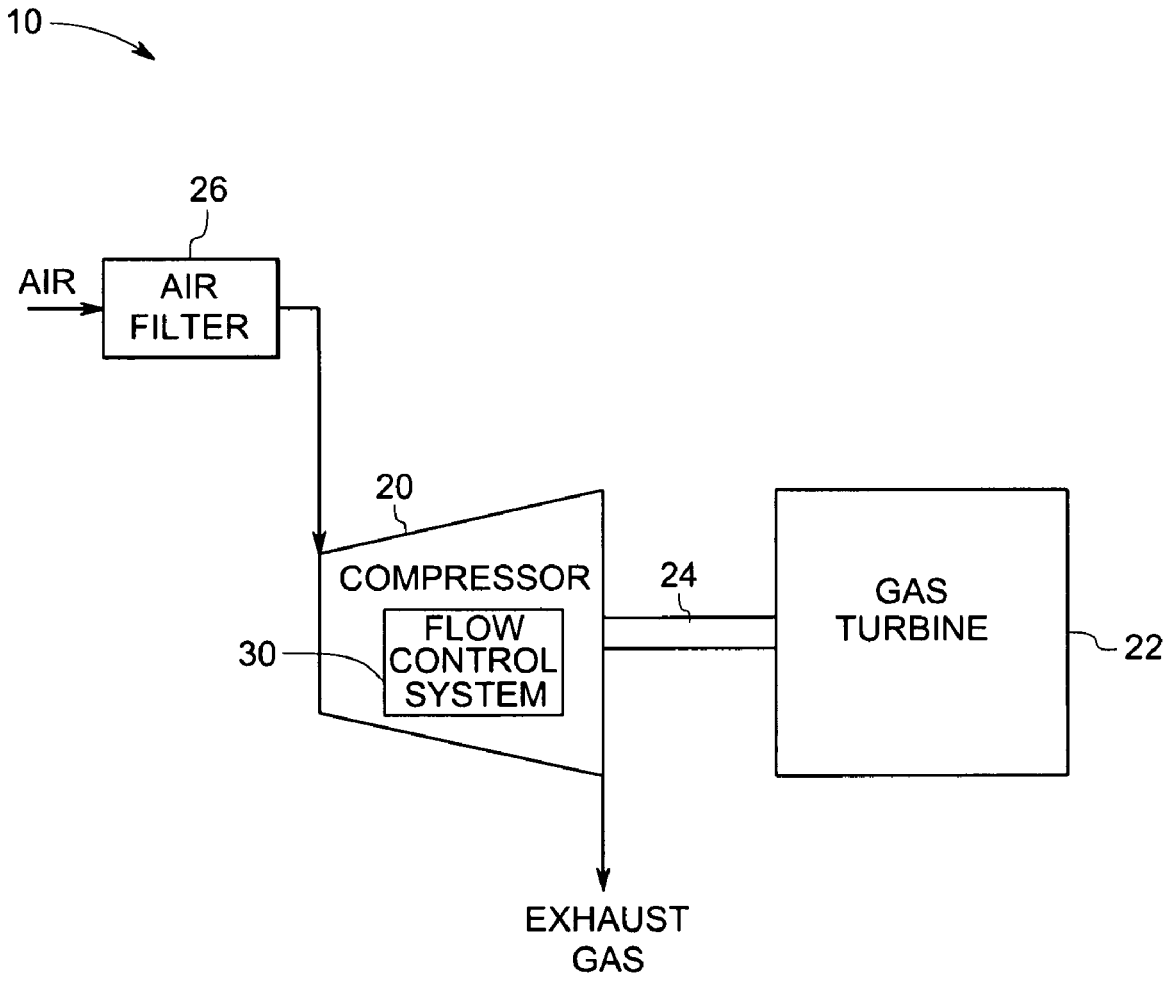
FIG. 1 is a diagrammatical representation of a compression system having a gas turbine driving a centrifugal compressor, in accordance with an exemplary aspect of the present invention.

Referring to FIG. 1, a compression system 10 is illustrated in accordance with certain embodiments of the present invention. The illustrated compression system 10 includes a centrifugal compressor 20 coupled to a gas turbine 22 via a mechanical shaft 24. A motor-generator unit may be mechanically coupled to the compressor 20. The compressor 20 draws ambient air through a filter 26 and provides compressed air to a downstream device.

To extend the operation range of the compressor 20 beyond the stall point, flow control is required to control the diffusion that precipitates stall. In accordance with the aspects of the present invention, the compressor 20 includes an exemplary flow control system 30 configured to stabilize the air flow through the compressor 20. Although the compressor 20 having the flow control system 30 is explained with respect to single or multi-stage centrifugal compressor that is motor driven or gas-turbine driven, in certain other exemplary embodiments, other systems such as locomotive turbochargers as known to those skilled in the art may also be envisaged. The compressor 20 having the flow control system 30 is explained in greater detail below with reference to subsequent figures.

Figure 2:
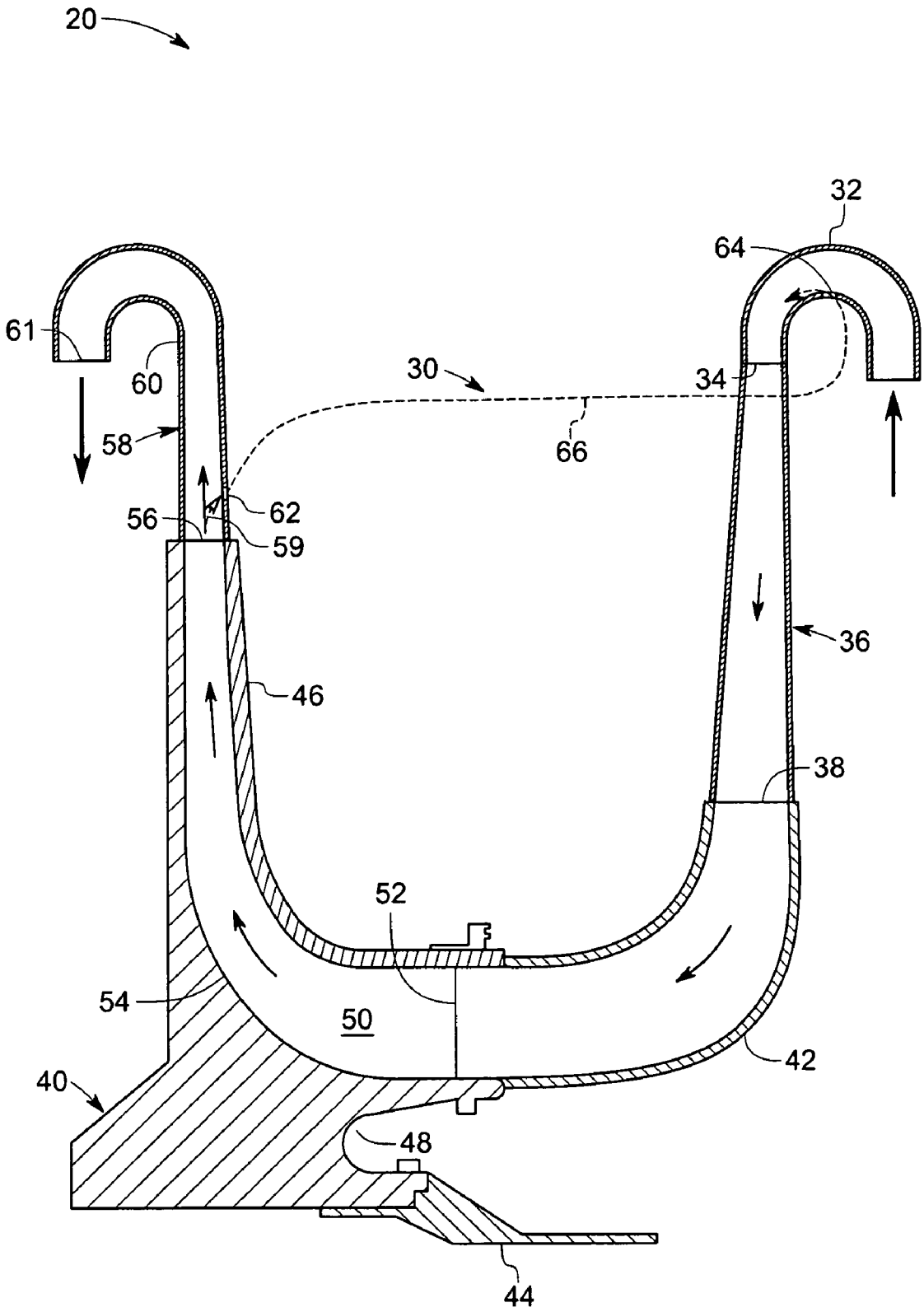
FIG. 2 is a diagrammatical representation of a centrifugal compressor having a flow control system in accordance with an exemplary aspect of the present invention.

Referring to FIG. 2, the centrifugal compressor 20 having the flow control system 30 in accordance with aspects of the present invention is illustrated. The illustrated centrifugal compressor 20 includes a first interconnecting duct 32 coupled to the leading edge 34 of a de-swirl vane unit 36. The ambient air enters the de-swirl vane unit 36 via the first interconnecting duct 32. In the illustrated embodiment, the first interconnecting duct 32 has a U-shaped cross-section such that air enters the duct 32 along a radially outward direction, then flows axially, and finally flows along a radially inward direction to the de-swirl vane unit 36. The de-swirl vane unit 36 includes a plurality of de-swirl vanes (not shown) that are spaced apart about a circumference of a ring. The de-swirl vanes are generally oriented radially with respect to an axis of the compressor 20. As known to those skilled in the art, the de-swirl vanes are arranged in such a way that the curvature of the de-swirl vanes at the leading edge is generally aligned in the same direction as the swirling flow entering the de-swirl vanes from the first interconnecting duct 32, while the curvature at the trailing edge directed substantially in a direction in which it is desired for the flow to exit the vanes. The de-swirl vanes are thus configured to remove tangential or swirl motion of the air flow. An outlet side 38 of the de-swirl unit 36 is coupled to an impeller 40 via a second interconnecting duct 42. The air flow is directed from the de-swirl vane unit 36 to the impeller 40 via the second interconnecting duct 42.

The impeller 40 is coupled to a central shaft 44 that rotates about a central axis within a stationary impeller shroud 46 (although in certain embodiments, certain impellers have rotating shrouds). The impeller 40 includes a central hub portion 48 and a plurality of vanes 50 located at a radial periphery of the impeller 40. The impeller vanes 50 re-direct the air flow radially outwards from an axial inlet (not shown) of the impeller 40, and increase the velocity of the air flow. Specifically, during operation, air engages with the impeller 40 along the leading edge 52 of each impeller vane 50. The flow is then directed through an annular air flow path defined by the impeller shroud 46 and a curved inner surface 54 of the central hub portion 48.

An exit 56 of the impeller 40 is coupled to a diffuser 58. Air is directed by the impeller 40 towards the diffuser 58 via the exit 56. The diffuser 58 includes typically a vaneless free space (60) or diffuser passages. In certain embodiments, the diffuser may include a plurality of diffuser vanes or a plurality of discrete diffuser pipes (not shown) located at intervals surrounding the impeller exit 56. The air flow through the diffuser slows as the area increases converting the high velocity of the impeller exit flow into high static pressure. The diffuser passages also de-swirl the air flow provided by the impeller 40. Air exits the diffuser 58 via a downstream end 61 of the diffuser passage 60. As mentioned above, the compressor 20 includes the flow control system 30 that facilitates a stabilization of the air flow within the compressor 20. The flow control system 30 includes a plurality of suction holes (e.g. annular suction holes) 62 provided in the diffuser 58 and are adapted to facilitate the suction of an air boundary layer 59 from the diffuser 58. A plurality of blowing holes (e.g. annular blowing holes) 64 are provided in the first interconnecting duct 32 and are adapted to blow into a boundary layer air for separation control in the first interconnecting duct 32. The suction holes 62 are coupled to the blowing holes 64 via a manifold 66. The manifold 66 is adapted to direct the flow control air from the suction holes 62 to the blowing holes 64. Certain exemplary aspects of the present invention are described in greater detail with respect to subsequent figures.

Figure 3:
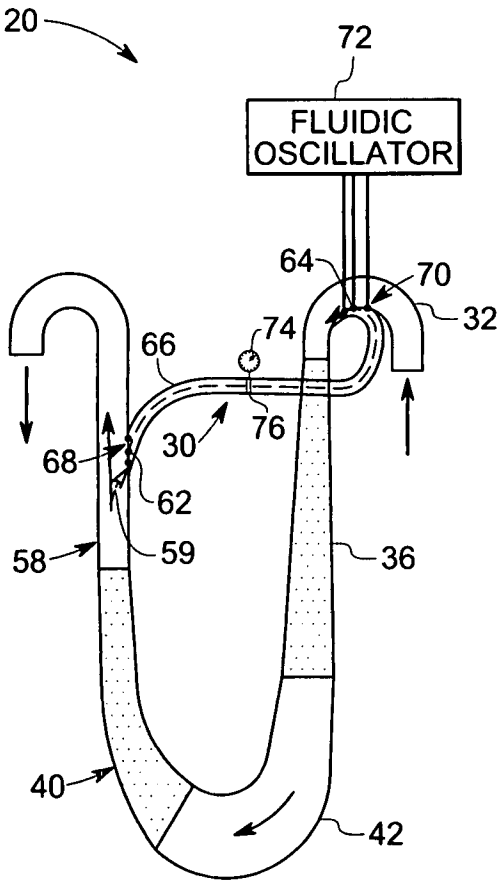
FIG. 3 is a diagrammatical representation of a centrifugal compressor having a flow control system in accordance with aspects of FIG. 2.

Referring to FIG. 3, the centrifugal compressor 20 having the flow control system 30 in accordance with aspects of present invention, is illustrated. As described previously, the flow control system 30 includes the plurality of suction holes 62 provided in the diffuser 58 that are adapted to facilitate the suction of the boundary layer air 59 from the diffuser 58. In the illustrated embodiment, the plurality of suction holes 62 are juxtaposed to a first location 68 of incipient boundary layer air separation in the diffuser 58. The plurality of blowing holes 64 are provided in the first interconnecting duct 32 and are adapted to blow into the boundary layer air into the first interconnecting duct 32. In the illustrated embodiment, the plurality of blowing holes 64 are juxtaposed to a location of incipient boundary layer separation in the first interconnecting duct 32 (i.e. a bend portion 70 of the first interconnecting duct 32). The suction holes 62 are coupled to the blowing holes 64 via the manifold 66. The manifold 66 is adapted to direct the flow control air from the suction holes 62 to the blowing holes 64.

As mentioned previously, when the volumetric flow rate through the centrifugal compressor 20 is low, flow through the compressor 20 becomes unstable. As a result, flow through the impeller 40 and the diffuser 58 becomes separated from a wall along length of the flow passage of the diffuser 58. Because the impeller 40 raises the pressure through work addition, a natural pressure difference between the first interconnecting duct 32 and the diffuser 58 results in self-aspiration of air through the manifold 66. Thus, a portion of the boundary layer air in the diffuser 58 is drawn via the manifold 66 and expelled into the first interconnecting duct 32. This boundary layer suction in the diffuser 58 facilitates the removal of the weak boundary layer proximate a surface of the diffuser 58 and suppresses boundary layer air separation in the diffuser 58. Suction through holes 62 curves flow streamlines of boundary layer air on either sides of the holes 62. Discrete suction of boundary layer air through the holes 62 is effective because holes 62 promote three dimensional vorticity and mixing of flow streamlines. The corresponding blowing in the first interconnecting duct 32 energizes the weak air flow proximate a surface in the first interconnecting duct 32 and suppresses boundary layer separation in the first interconnecting duct. The blowing holes 64 are configured in such a way that so as to deliver the air flow at a predetermined angle to promote the mixing of blowing air stream and the primary air stream in the interconnecting duct 32. Discrete injection of boundary layer air through holes 64 is effective because discrete injection promotes three dimensional vorticity and mixing of flow streamlines. As a result, operability of the compressor is enhanced.

In certain embodiments, at least one fluidic oscillator 72 may be provided between an exit of the manifold 66 and the blowing holes 64 configured to facilitate pulsed blowing into the boundary layer via the blowing holes 64 to enhance the efficiency of the flow control in the compressor 20 as appreciated by those skilled in the art. The fluidic oscillator 72 may be disposed in other arrangements as well in accordance with aspects of the present invention. In one embodiment, the fluidic oscillator 72 may be a passive fluidic oscillator. Steady boundary layer blowing in traditional applications, feeds air taken from high-pressure sources into the interior wall carrying the flow to an incipient separation point of the flow. When applied to gas turbine engine systems, the extraction of the high-pressure air results in a penalty on overall engine performance and efficiency. Therefore boundary layer injection should be implemented as efficiently as possible and the flow requirements should be minimized in order to achieve a net positive impact on engine performance. A means to improve injection efficiently is through unsteady blowing where air is pulsed into the boundary layer upstream of the separation point. In one example, the use of unsteady blowing via fluidic oscillators to prevent separation of the boundary layer reduces the necessary amount of mass required by steady blowing by factors ranging from 2 to about 100. The fluidic oscillator 72 may also include a rotary valve, solenoid valve, siren valve, or the like. A flow-metering device 74 is coupled to the manifold 66 and adapted to monitor the flow of boundary layer air through the manifold 66. The flow metering device 74 may include an orifice 76 or an array of orifices.

Figure 4:
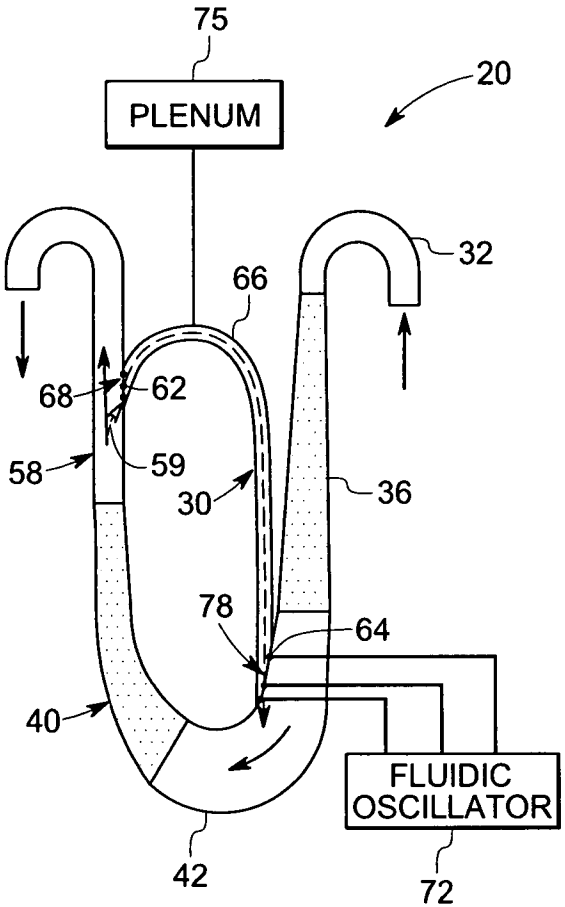
FIG. 4 is a diagrammatical representation of a centrifugal compressor having a flow control system in accordance with an exemplary aspect of the present invention.

Referring to FIG. 4, another exemplary embodiment of the centrifugal compressor 20 having the flow control system 30 is illustrated. In the illustrated embodiment, the flow control system 30 includes the plurality of suction holes 62 provided in the diffuser 58, and the suction holes are adapted to facilitate the suction of boundary layer air 59 from the diffuser 58. The plurality of blowing holes 64 are provided in the second interconnecting duct 42 and are adapted to blow the boundary layer air into the second interconnecting duct 42. In the illustrated embodiment, the plurality of blowing holes 64 are juxtaposed to a third location 78 of incipient boundary layer air separation in the second interconnecting duct 42 (i.e. duct provided between the de-swirl vane unit 36 and the impeller 40). The suction holes 62 are coupled to the blowing holes 64 via the manifold 66. The manifold 66 is adapted to direct the flow control air from the suction holes 62 to the blowing holes 64. The flow-metering device 74 is coupled to the manifold 66 and adapted to monitor the flow of boundary layer air through the manifold 66. In the illustrated embodiment, the flow-metering device 74 may include a plenum 75 adapted to monitor the flow of boundary layer air through the manifold 66.

A portion of the boundary layer air in the diffuser 58 is drawn via the manifold 66 and expelled into the second interconnecting duct 42. This boundary layer suction in the diffuser 58 facilitates the removal of the weak boundary layer in the diffuser 58 and suppresses boundary layer separation in the diffuser 58. The corresponding blowing of air in the second interconnecting duct 42 energizes the weak air flow along a surface in the second interconnecting duct 42, and suppresses boundary layer separation in the second interconnecting duct 42. Because the impeller 40 raises the pressure through work addition, a natural pressure difference between the second interconnecting duct 42 and the diffuser 58 results in self-aspiration of air through the manifold 66. Fluidic oscillators may be employed to facilitate pulsed blowing into the boundary layer in the second interconnecting duct 42.

Figure 5:
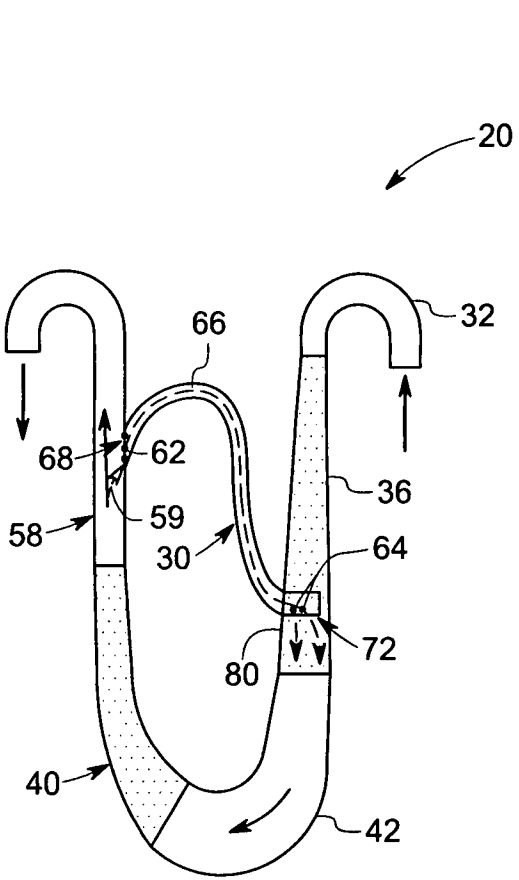
FIG. 5 is a diagrammatical representation of a centrifugal compressor having a flow control system in accordance with an exemplary aspect of the present invention.

Referring to FIG. 5, another exemplary embodiment of the centrifugal compressor 20 having the flow control system 30 is illustrated. In the illustrated embodiment, the flow control system 30 includes the plurality of suction holes 62 provided in the diffuser 58 and the suction holes are adapted to facilitate the suction of boundary layer air 59 from the diffuser 58. The plurality of blowing holes 64 are provided in the de-swirl vane unit 36 and are adapted to blow the air into the de-swirl vane unit 36. In the illustrated embodiment, the plurality of blowing holes 64 are juxtaposed to a fourth location 80 (i.e. suction side) of incipient boundary layer separation in the de-swirl vane unit 36. The suction holes 62 are coupled to the blowing holes 64 via the manifold 66. The manifold 66 is adapted to direct the boundary layer air from the suction holes 62 to the blowing holes 64.

A portion of the boundary layer air in the diffuser 58 is drawn via the manifold 66 and expelled into the de-swirl vane unit 36. This boundary layer suction in the diffuser 58 facilitates the removal of the weak boundary layer in the diffuser 58 and suppresses boundary layer separation in the diffuser. The corresponding air flow expulsion in the de-swirl vane unit 36 energizes the weak air flow in the de-swirl vane unit 36 and suppresses boundary layer separation along the vane surface. Because the impeller 40 raises the pressure through work addition, a natural pressure difference between the de swirl vane unit 36 and the diffuser 58 results in self-aspiration of air through the manifold 66. Fluidic oscillators may be employed to facilitate pulsed blowing into the boundary layer in the de-swirl vane unit 36.

Figure 6:
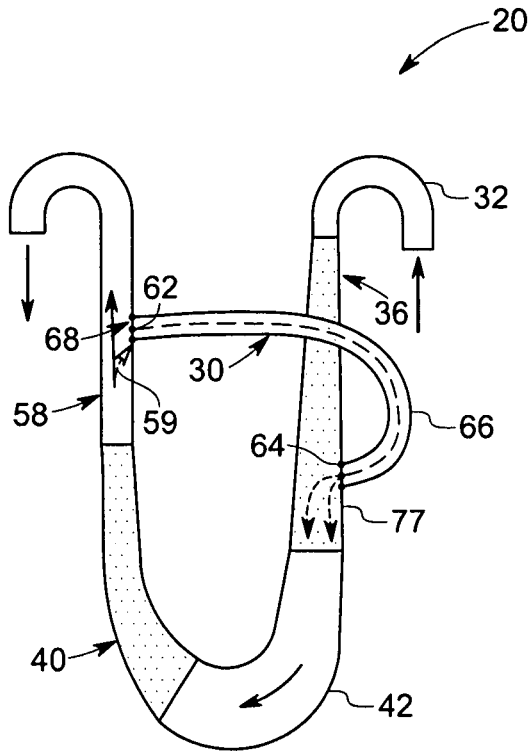
FIG. 6 is a diagrammatical representation of a centrifugal compressor having a flow control system in accordance with an exemplary aspect of the present invention.

Referring to FIG. 6, another exemplary embodiment of the centrifugal compressor 20 having the flow control system 30 is illustrated. In the illustrated embodiment, the flow control system 30 includes the plurality of suction holes 62 provided in the diffuser 58 and is adapted to facilitate the suction of boundary layer air 59 from the diffuser 58. The plurality of blowing holes 64 are provided in the de-swirl vane unit 36 and are adapted to blow the air into the de-swirl vane unit 36. In the illustrated embodiment, the plurality of blowing holes 64 are juxtaposed to a fifth location 77 (i.e. end wall side) of incipient boundary layer separation in the de-swirl vane unit 36. The suction holes 62 are coupled to the blowing holes 64 via the manifold 66. The manifold 66 is adapted to direct the boundary layer air from the suction holes 62 to the blowing holes 64.

A portion of the boundary layer air in the diffuser 58 is drawn via the manifold 66 and expelled into the de-swirl vane unit 36. This boundary layer suction in the diffuser 58 facilitates the removal of the weak boundary layer in the diffuser 58 and suppresses boundary layer separation in the diffuser 58. The corresponding air flow expulsion in the de-swirl vane unit 36 energizes the weak air flow in the de-swirl vane unit 36 and suppresses boundary layer separation along the vane surface. Because the impeller 40 raises the pressure through work addition, a natural pressure difference between the de swirl vane unit 36 and the diffuser 58 results in self-aspiration of air through the manifold 66.

Figure 7:
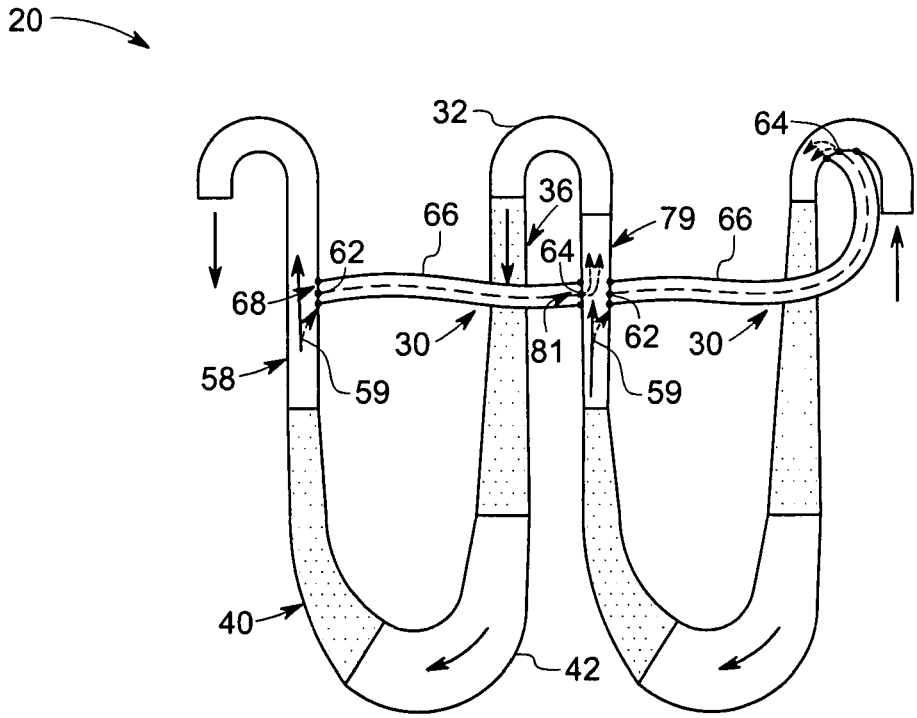
FIG. 7 is a diagrammatical representation of a multi-stage centrifugal compressor having a flow control system in accordance with an exemplary aspect of the present invention.

Referring to FIG. 7, another exemplary embodiment of the centrifugal compressor 20 (multi-stage) having the flow control system 30 is illustrated. In the illustrated embodiment, the flow control system 30 includes the plurality of suction holes 62 provided in the downstream diffuser 58 and is adapted to facilitate the suction of boundary layer air 59 from the diffuser 58. The plurality of blowing holes 64 are provided in an upstream diffuser 79 of another compression stage and are adapted to blow the air into the boundary layer along the upstream diffuser wall opposing boundary layer suction. In the illustrated embodiment, the plurality of blowing holes are juxtaposed to a sixth location 81 (i.e. case side) of incipient boundary layer separation in the upstream diffuser 79. The suction holes 62 are coupled to the blowing holes 64 via the manifold 66. The manifold 66 is adapted to direct the boundary layer air from the suction holes 62 to the blowing holes 64.

A portion of the boundary layer air in the downstream diffuser 58 is drawn via the manifold 66 and expelled into the upstream diffuser 79. This boundary layer suction in the diffuser 58 facilitates the removal of the weak boundary layer in the downstream diffuser 58 and suppresses boundary layer separation in the downstream diffuser 58. The corresponding air flow expulsion in the upstream diffuser 79 energizes the weak air flow in the upstream diffuser 79 and suppresses boundary layer separation along the surface 81 opposing the suction holes. Because the impeller 40 raises the pressure through work addition, a natural pressure difference between the upstream diffuser 79 and the downstream diffuser 58 results in self-aspiration of air through the manifold 66. Fluidic oscillators may be employed to facilitate pulsed blowing into the boundary layer in the upstream diffuser 79.

In the illustrated embodiment, the flow control system 30 is also provided between the upstream diffuser 79 and an upstream interconnecting duct 73 of the multi-stage compressor. In another exemplary embodiment, the flow control system in accordance with aspects of the present invention is provided only between the upstream diffuser 79 and the downstream diffuser 58 of the multi-stage compressor.

Figure 8:
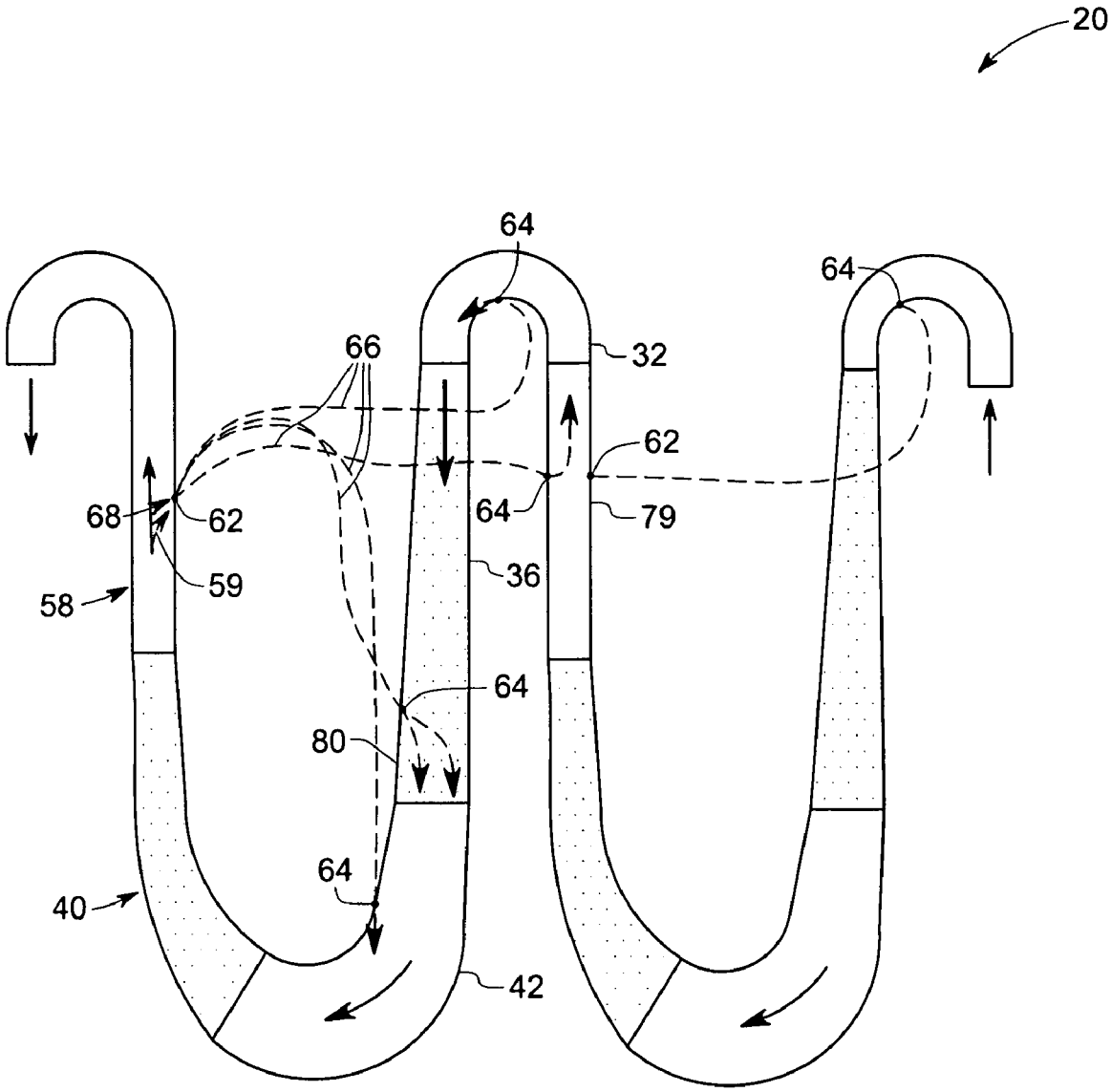
FIG. 8 is a diagrammatical representation of a multi-stage centrifugal compressor having a flow control system in accordance with an exemplary aspect of the present invention.

Referring to FIG. 8, another exemplary embodiment of the centrifugal compressor (multi-stage) 20 having the flow control system 30 is illustrated. As described previously, the flow control system 30 includes the plurality of suction holes 62 provided in the diffuser 58 and are adapted to facilitate the suction of boundary layer air 59 from the diffuser. The plurality of blowing holes 64 are provided in the first interconnecting duct 32, in the second interconnecting duct 42, in the suction side 80 of the de-swirl vane unit 36, and the upstream diffuser 79. The suction holes 62 are coupled to the blowing holes 64 via the manifolds 66. The manifold 66 is adapted to direct the flow control air from the suction holes 62 to the blowing holes 64.

Figure 9:
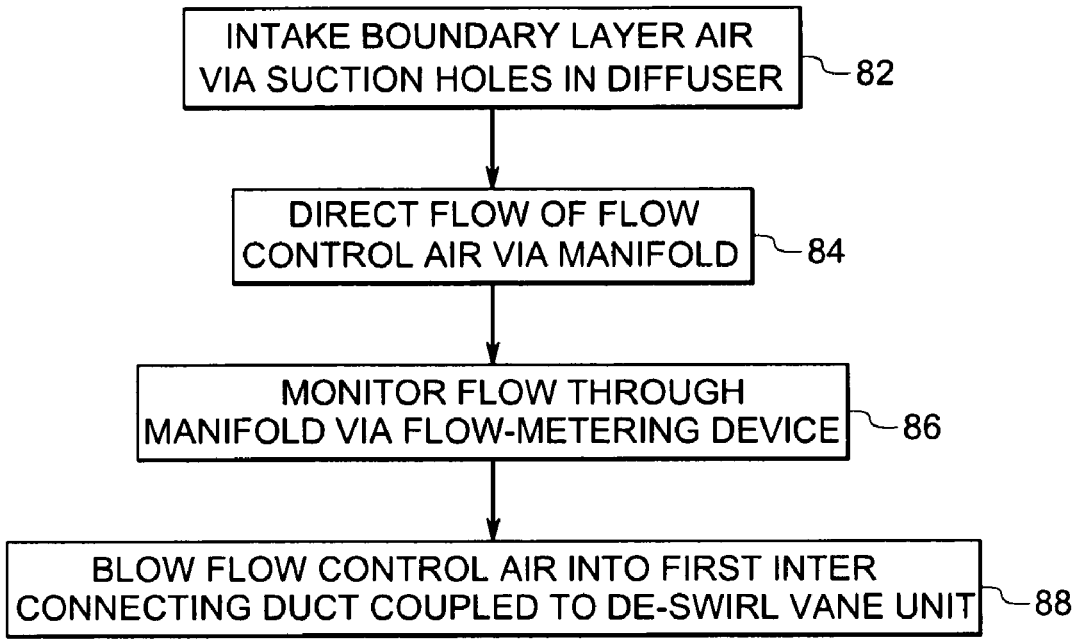
FIG. 9 is a flow chart illustrating an exemplary process involved in method of controlling air flow in a centrifugal compressor in accordance with aspects of FIG. 3.

Referring generally to FIG. 9, flow chart representing steps involved in method of controlling air flow in the centrifugal compressor 20 in accordance with aspects of FIG. 3 is illustrated. The method includes intaking the boundary layer air via the plurality of suction holes 62 (slots) provided in the diffuser 58 as represented by step 82. During operation of the compressor, the pressure difference between the diffuser 58 and the first interconnecting duct 32, results in self-aspiration of air through the manifold 66 as represented by step 84. The boundary layer suction in the diffuser 58 facilitates the removal of the weak boundary layer in the diffuser 58. The flow of flow control air via the manifold 66 is monitored via the flow metering device 74 as represented by step 86. The manifold 66 directs the boundary layer air from the suction holes 62 to the blowing holes 64. The flow control air is injected into the first interconnecting duct 32 coupled to the de-swirl vane unit 36 via the plurality of blowing holes 64 as represented by step 88. The corresponding blowing into the first interconnecting duct 32 energizes the weak air flow along the surface in the first interconnecting duct 32 and suppresses boundary layer separation in the duct 32.

Figure 10:
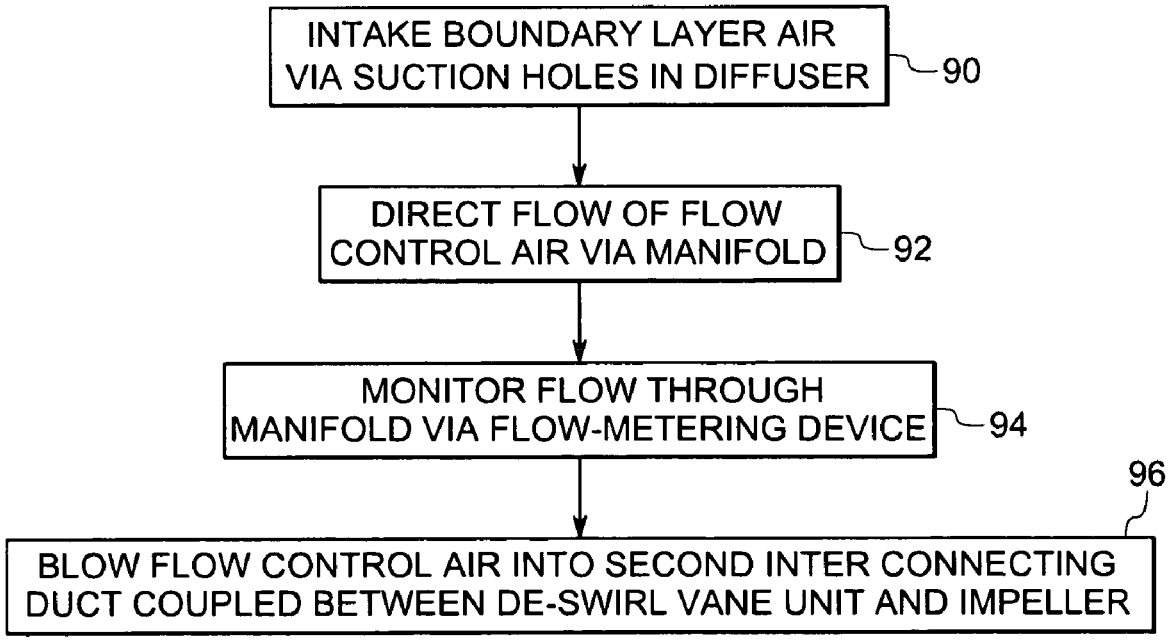
FIG. 10 is a flow chart illustrating an exemplary process involved in method of controlling air flow in a centrifugal compressor in accordance with aspects of FIG. 4.

Referring generally to FIG. 10, flow chart representing steps involved in method of controlling air flow in the centrifugal compressor 20 in accordance with aspects of FIG. 4 is illustrated. The method includes intaking the boundary layer air via a plurality of suction holes 62 provided in the diffuser 58 as represented by step 90. During operation of the compressor, the pressure difference between the second interconnecting duct 42 and the diffuser 58 results in self-aspiration of flow control air through the manifold 66 as represented by step 92. The boundary layer suction in the diffuser 58 facilitates the removal of the weak boundary layer in the diffuser 58. The flow of flow control air via the manifold 66 is monitored via the flow metering device 74 as represented by step 94. The manifold 66 directs the flow control air from the suction holes 62 to the blowing holes 64. The flow control air is injected into second interconnecting duct 32 coupled between the de-swirl vane unit 36 and the impeller, via the plurality of blowing holes 64 as represented by step 96. The corresponding blowing into the second interconnecting duct 42 energizes the weak flow along the surface in the second interconnecting duct 42 and suppresses boundary layer separation in the second interconnecting duct 42.

Figure 11:
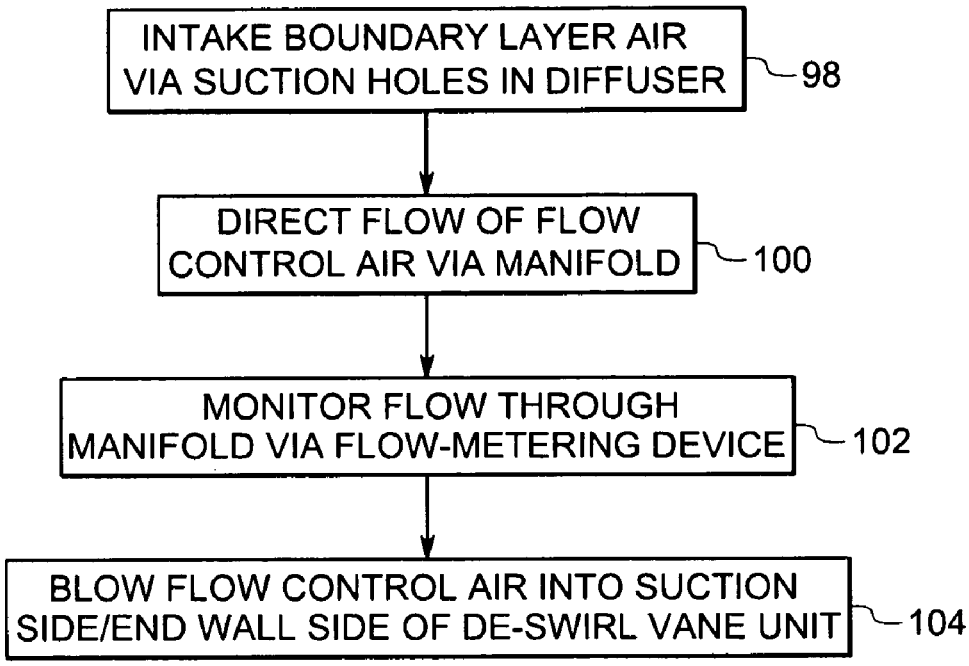
FIG. 11 is a flow chart illustrating an exemplary process involved in method of controlling air flow in a centrifugal compressor in accordance with aspects of FIGS. 5 and 6.

Referring generally to FIG. 11, flow chart representing steps involved in method of controlling air flow in the centrifugal compressor 20 in accordance with aspects of FIGS. 5 and 6 is illustrated. The method includes intaking the boundary layer air via a plurality of suction holes 62 provided in the diffuser 58 as represented by step 98. During operation of the compressor, the pressure difference between the de-swirl vane unit 36 and the diffuser 58, results in self-aspiration of flow control air through the manifold 66 as represented by step 100. The boundary layer suction in the diffuser 58 facilitates the removal of the weak boundary layer in the diffuser 58. The flow of flow control air via the manifold 66 is monitored via the flow metering device 74 as represented by step 102. The manifold 66 directs the flow control air from the suction holes 62 to the blowing holes 64. The flow control air is injected into the suction side 80 or the end wall side 77 of the de-swirl vane unit 36, via the plurality of blowing holes 64 as represented by step 104. The corresponding blowing in the de-swirl vane unit 36 energizes the weak flow along the surface in the de-swirl vane unit 36 and suppresses boundary layer separation in the de-swirl vane unit.

Figure 12:
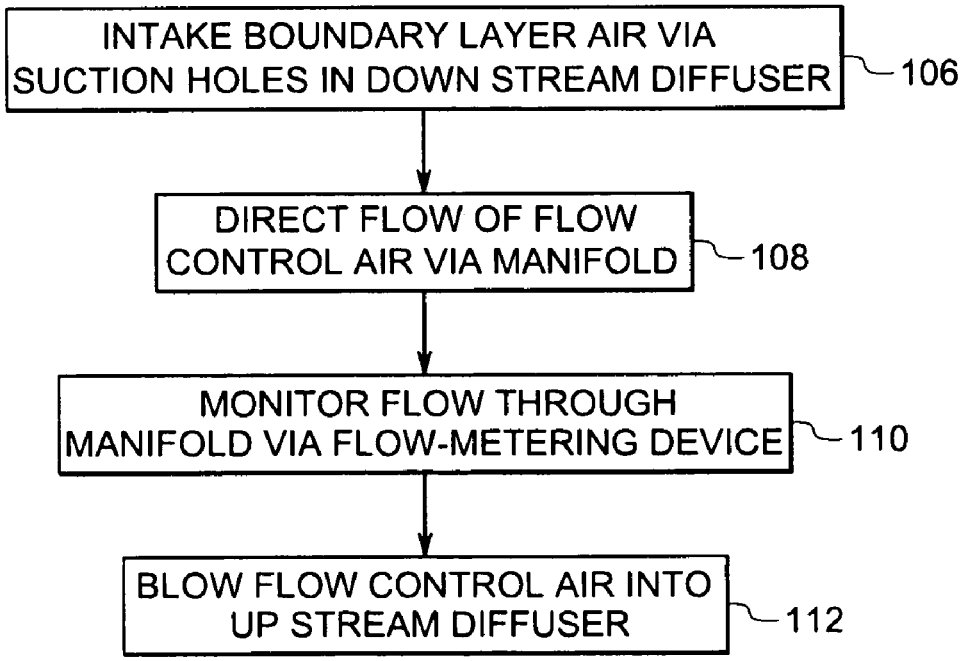
FIG. 12 is a flow chart illustrating an exemplary process involved in method of controlling air flow in a multi-stage centrifugal compressor in accordance with aspects of FIG. 7.

Referring generally to FIG. 12, flow chart representing steps involved in method of controlling air flow in the centrifugal compressor 20 in accordance with aspects of FIG. 7 is illustrated. The method includes intaking the boundary layer air via a plurality of suction holes 62 provided in the downstream diffuser 58 as represented by step 106. During operation of the compressor, the pressure difference between the upstream diffuser 79 and the downstream diffuser 58 results in self-aspiration of flow control air through the manifold 66 as represented by step 108. The boundary layer suction in the downstream diffuser 58 facilitates the removal of the weak boundary layer in the downstream diffuser 58. The flow of flow control air via the manifold 66 is monitored via the flow metering device 74 as represented by step 110. The manifold 66 directs the air boundary layer from the suction holes 62 to the blowing holes 64. The flow control air is injected into the opposing wall of the upstream diffuser 79 via the plurality of blowing holes 64 as represented by step 112. The corresponding blowing into the upstream diffuser energizes the weak flow along the surface in the upstream diffuser 79 and suppresses boundary layer separation in the upstream diffuser 79.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A flow control system for a centrifugal compressor, comprising:

a plurality of suction holes provided in a diffuser and configured to facilitate suction of a flow control stream from a boundary layer fluid of the diffuser;

a plurality of blowing holes provided in an interconnecting duct coupled to a de-swirl vane unit and configured to facilitate blowing of the flow control stream into a boundary layer fluid of the interconnecting duct;

a manifold coupled between the suction holes and the blowing holes and configured to direct flow of the flow control stream from the suction holes to the blowing holes; and a fluidic oscillator provided juxtaposed to the blowing holes and configured to facilitate pulsed blowing of the flow control stream into the boundary layer fluid in the interconnecting duct via the blowing holes.

2. The flow control system of claim 1, wherein the plurality of suction holes are juxtaposed to a location of incipient boundary layer fluid separation in the diffuser.

3. The flow control system of claim 1, further comprising a flow-metering device provided in the manifold and configured to monitor the flow of the flow control stream.

4. The flow control system of claim 3, wherein the flow-metering device comprises at least one orifice.

5. The flow control system of claim 3, wherein the flow-metering device comprises a plenum.

6. The flow control system of claim 1, wherein the plurality of blowing holes are juxtaposed to a location of incipient boundary layer fluid separation in the interconnecting duct.

7. A flow control system for a centrifugal compressor, comprising:

a plurality of suction holes provided in a diffuser and configured to facilitate suction of a flow control stream from a boundary layer fluid of the diffuser;

a plurality of blowing holes provided in an interconnecting duct coupled between a de-swirl vane unit and an impeller; wherein the blowing holes are configured to facilitate blowing of the flow control stream into a boundary layer fluid in the interconnecting duct; and a manifold coupled between the suction holes and the blowing holes and configured to direct flow of the flow control stream from the suction holes to the blowing holes.

8. The flow control system of claim 7, wherein the plurality of suction holes are juxtaposed to a location of incipient boundary layer fluid separation in the diffuser.

9. The flow control system of claim 7, wherein the plurality of blowing holes are juxtaposed to a location of incipient boundary layer fluid separation in the interconnecting duct.

10. The flow control system of claim 7, further comprising a fluidic oscillator provided juxtaposed to the blowing holes and configured to facilitate pulsed blowing of the flow control stream into the boundary layer fluid in the interconnecting duct via the blowing holes.

11. A flow control system for a centrifugal compressor, comprising:

a plurality of suction holes provided in a diffuser and configured to facilitate suction of a flow control stream from a boundary layer fluid of the diffuser;

a plurality of blowing holes provided in a de-swirl vane unit and configured to facilitate blowing of the flow control stream into a boundary layer fluid in the de-swirl vane unit; and a manifold coupled between the suction holes and the blowing holes and configured to direct flow of the flow control stream from the suction holes to the blowing holes.

12. The flow control system of claim 11, wherein the plurality of suction holes are juxtaposed to a location of incipient boundary layer fluid separation in the diffuser.

13. The flow control system of claim 11, wherein the plurality of blowing holes are juxtaposed to a location of incipient boundary layer fluid separation in a suction side of the de-swirl vane unit.

14. The flow control system of claim 11, wherein the plurality of blowing holes are juxtaposed to a location of incipient boundary layer fluid separation in an end wall side of the de-swirl vane unit.

15. The flow control system of claim 11, further comprising a fluidic oscillator provided juxtaposed to the blowing holes and configured to facilitate pulsed blowing of the flow control stream into the boundary layer fluid in the de-swirl vane unit via the blowing holes.

16. A flow control system for a centrifugal compressor, comprising:

a plurality of suction holes provided in a downstream diffuser and configured to facilitate suction of a flow control stream from a boundary layer fluid of the downstream diffuser;

a plurality of blowing holes provided in an upstream diffuser coupled to a de-swirl vane unit and configured to facilitate blowing of the flow control stream into a boundary layer fluid in the upstream diffuser; and a manifold coupled between the suction holes and the blowing holes and configured to direct flow of the flow control stream from the suction holes to the blowing holes.

17. The flow control system of claim 16, wherein the plurality of suction holes are juxtaposed to a location of incipient boundary layer fluid separation in the downstream diffuser.

18. The flow control system of claim 16, wherein the plurality of blowing holes are juxtaposed to a location of incipient boundary layer fluid separation in the upstream diffuser.

19. A method for controlling fluid flow in a centrifugal compressor, comprising:

intaking a flow control stream from a boundary layer fluid via a plurality of suction holes provided in a diffuser;

directing flow of the flow control stream from the suction holes to a plurality of blowing holes provided in an interconnecting duct coupled to a de-swirl vane unit; and blowing the flow control stream into a fluid boundary layer in the interconnecting duct coupled to a de-swirl vane unit, via the plurality of blowing holes.

20. The method of claim 19, wherein intaking a flow control stream comprises intaking fluid via the plurality of suction holes juxtaposed to a location of incipient boundary layer fluid separation in the diffuser.

21. The method of claim 19, wherein directing flow of the flow control stream from the suction holes to the plurality of blowing holes comprises directing flow of the flow control stream from the suction holes to the plurality of blowing holes via a manifold.

22. The method of claim 21, further comprising monitoring the flow of the flow control stream via a flow-metering device provided in the manifold.

23. The method of claim 19, wherein blowing the flow control stream into the first interconnecting duct comprises blowing the flow control stream into the first interconnecting duct via the plurality of blowing holes juxtaposed to a location of incipient boundary layer fluid separation in the interconnecting duct.

24. The method of claim 19, wherein blowing the flow control stream into the interconnecting duct comprises facilitating pulsed blowing via a fluidic oscillator provided juxtaposed to the blowing holes.

25. A method for controlling fluid flow in a centrifugal compressor, comprising:

intaking a flow control stream from a fluid boundary layer via a plurality of suction holes provided in a diffuser;

directing flow of the flow control stream from the suction holes to a plurality of blowing holes provided in an interconnecting duct coupled between a de-swirl vane unit and an impeller; and blowing the flow control stream into the interconnecting duct, via the plurality of blowing holes.

26. The method of claim 25, wherein intaking a flow control stream comprises intaking fluid via the plurality of suction holes juxtaposed to a location of incipient boundary layer fluid separation in the diffuser.

27. The method of claim 25, wherein blowing the flow control stream into the interconnecting duct comprises blowing the flow control stream into the interconnecting duct via the plurality of blowing holes juxtaposed in a location of incipient boundary layer fluid separation in the interconnecting duct.

28. A method for controlling fluid flow in a centrifugal compressor, comprising:

intaking a flow control stream from a fluid boundary layer via a plurality of suction holes provided in a diffuser;

directing flow of the flow control stream from the suction holes to a plurality of blowing holes provided in a de-swirl vane unit; and blowing the flow control stream into the de-swirl vane unit, via the plurality of blowing holes.

29. The method of claim 28, wherein intaking a flow control stream comprises intaking fluid via a plurality of suction holes juxtaposed to a location of incipient boundary layer fluid separation in the diffuser.

30. The method of claim 28, wherein blowing the flow control stream into the de-swirl vane unit comprises blowing the fluid boundary layer into the de-swirl vane unit via the plurality of blowing holes juxtaposed in a location of incipient fluid boundary layer separation in the suction side of the de-swirl vane unit.

31. The method of claim 28, wherein blowing the flow control stream into the de-swirl vane unit comprises blowing the fluid boundary layer into the de-swirl vane unit via the plurality of blowing holes juxtaposed in a location of incipient boundary layer fluid separation in an end wall side of the de-swirl vane unit.

* * * * *